US010358697B2

(12) United States Patent
Horie

(10) Patent No.: US 10,358,697 B2
(45) Date of Patent: Jul. 23, 2019

(54) CU—CO—NI—SI ALLOY FOR ELECTRONIC COMPONENTS

(71) Applicant: JX Nippon Mining & Metals Corporation, Tokyo (JP)

(72) Inventor: Hiroyasu Horie, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 274 days.

(21) Appl. No.: 15/284,685

(22) Filed: Oct. 4, 2016

(65) Prior Publication Data

US 2017/0096725 A1 Apr. 6, 2017

(30) Foreign Application Priority Data

Oct. 5, 2015 (JP) ..... 2015-197858

(51) Int. Cl.
*C22C 9/06* (2006.01)
*H01B 1/02* (2006.01)

(52) U.S. Cl.
CPC ..... *C22C 9/06* (2013.01); *H01B 1/023* (2013.01); *H01B 1/026* (2013.01)

(58) Field of Classification Search
None
See application file for complete search history.

(56) References Cited

U.S. PATENT DOCUMENTS

2004/0079456 A1* 4/2004 Mandigo ..... C22C 9/06 148/554
2008/0298998 A1* 12/2008 Kaneko ..... C22C 9/06 420/472
2009/0035174 A1 2/2009 Era et al.
2009/0301614 A1* 12/2009 Era ..... C22C 9/06 148/554
2010/0170595 A1* 7/2010 Kaneko ..... C22C 9/06 148/554
2011/0244260 A1* 10/2011 Kuwagaki ..... C22C 9/06 428/546
2014/0116583 A1* 5/2014 Kamada ..... H01B 1/026 148/682
2015/0357074 A1* 12/2015 Kimura ..... C22C 9/06 148/682

FOREIGN PATENT DOCUMENTS

| | | | | |
|---|---|---|---|---|
| CN | 101146920 | A | | 3/2008 |
| EP | 2508632 | A1 | | 10/2012 |
| JP | 2009-007666 | A | | 1/2009 |
| JP | 2011/017072 | A | * | 1/2011 |
| JP | 2011/084764 | A | * | 4/2011 |
| WO | 2011068124 | A1 | | 6/2011 |
| WO | WO 2014/126047 | A1 | * | 8/2014 |

OTHER PUBLICATIONS

English translation of JP 2011/084764, Apr. 2011; 41 pages.*
English translation of JP 2011/017072, Jan. 2011; 18 pages.*

* cited by examiner

*Primary Examiner* — Helene Klemanski
(74) *Attorney, Agent, or Firm* — Drinker Biddle & Reath LLP

(57) ABSTRACT

The present invention provides a Cu—Co—Ni—Si alloy for an electronic component having improved reliability in which in addition to high strength and high electrical conduction, bendability generally difficult to achieve with strength is also provided to a Corson copper alloy. The present invention is a Cu—Co—Ni—Si alloy for an electronic component comprising 0.5 to 3.0% by mass of Co and 0.1 to 1.0% by mass of Ni, a concentration (% by mass) ratio of Ni to Co (Ni/Co) being adjusted in the range of 0.1 to 1.0, the alloy comprising Si so that a (Co+Ni)/Si mass ratio is in the range of 3 to 5, and comprising a balance comprising Cu and unavoidable impurities, wherein a coefficient of variation of concentration ratios of Co to Ni (Co/Ni) measured for at least 100 second-phase particles is 20% or less.

6 Claims, No Drawings

CU—CO—NI—SI ALLOY FOR ELECTRONIC COMPONENTS

BACKGROUND OF THE INVENTION

Field of the Invention

The present invention relates to a Cu—Co—Ni—Si alloy for an electronic component suitable for electronic components, particularly, connectors, battery terminals, jacks, relays, switches, lead frames, and the like.

Description of the Related Art

Conventionally, generally, as materials for electrical and electronic equipment, in addition to iron-based materials, copper-based materials such as phosphor bronze, red brass, and brass having excellent electrical conductivity and thermal conductivity has been also widely used. In recent years, a demand for the miniaturization, weight reduction, and higher functionality of electrical and electronic equipment and further higher density mounting accompanying these has increased, and various characteristics have also been required of copper-based materials applied to these.

With the miniaturization of components, the thinning of materials advances, and the improvement of material strength is required. In applications such as relays, the demand for fatigue characteristics increases, and the improvement of strength is necessary. In addition, with the miniaturization of components, the conditions when a material is subjected to bending work become severe, and the material is required to have excellent bending workability while having high strength. Further, after the material is worked into a component, heat may be generated with an increase in the amount of electric current passed, and the improvement of electrical conductivity is required from the viewpoint of heat generation suppression.

Japanese Patent Laid-Open No. 2009-007666 discloses a Cu—Ni—Co—Si-based alloy having an excellent balance of bending workability, strength, and electrical conductivity, in which R{200} is 0.3 or more when the diffraction intensity from the (111) face on the sheet surface is I{111}, the diffraction intensity from the (200) face is I{200}, the diffraction intensity from the (220) face is I{220}, the diffraction intensity from the (311) face is I{311}, and the proportion of the diffraction intensity from the (200) face in these diffraction intensities is R{200}=I{200}/{I{111}+I{200}+I{220}+I{311}}.

International Publication No. WO 2011/068124 discloses a copper alloy sheet material for electrical and electronic components according to the present invention having high strength and good bending workability and moreover having high electrical conductivity and specifically discloses a technique that achieves both strength and bending workability by obtaining an area ratio of less than 10% for crystal grains having a deviation angle from the Cube orientation (orientation difference) of less than 15° and obtaining an area ratio of 15% or more for crystal grains having a deviation angle from the Cube orientation of 15 to 30° in the results of measurement by a SEM-EBSD method.

CITATION LIST

Patent Document

[Patent Document 1] Japanese Patent Laid-Open No. 2009-007666

[Patent Document 2] International Publication No. WO 2011/068124

SUMMARY OF INVENTION

Technical Problem

According to the description of Patent Document 1, R{200} in the final state after all steps are completed is greatly governed by crystal orientation developing in the recrystallization of the material occurring during the last intermediate solution heat treatment in the manufacturing process, and therefore the steps before the last intermediate solution heat treatment are preferably properly adjusted, and specifically, after cold rolling with a reduction ratio of 50% or more, and heat treatment such that the material is partially recrystallized or a recrystallized structure having an average crystal grain size of 5 μm or less is obtained, followed by cold rolling with a reduction ratio of 50% or less, the last intermediate solution heat treatment is performed, thereby achieving the desired diffraction intensity.

In addition, in Patent Document 2, it is described that the copper alloy sheet material is manufactured through the steps of casting, hot rolling, cold rolling 1, intermediate annealing, cold rolling 2, solution heat treatment, cold rolling 3, aging heat treatment finishing cold rolling, and low temperature annealing, and the desired texture is formed by setting the rolling ratio of the cold rolling 1 at 70% or more, or performing the solution treatment at 600 to 1000° C. for 5 seconds to 300 seconds, or performing the cold rolling 3 with a rolling ratio of 5 to 40%, and it is described that performing different friction rolling by rolls for cold rolling having different roughnesses, particularly in the cold rolling 3 is effective.

Also in the future, in addition to high strength and high electrical conduction, bendability is also required of Corson copper alloys, and generally it is difficult to achieve both strength and bendability. From the viewpoint of the improvement of reliability, there is room for improvement.

Solution to Problem

The present inventor has studied diligently and as a result found optimal solution treatment conditions from the viewpoint that when the compositions of precipitates can be made uniform in a Cu—Co—Ni—Si alloy, dislocations are uniform, and the stress during bending work is dispersed, and the improvement of bending workability is expected, and completed the present invention.

Specifically, the present invention is as follows.

(1) A Cu—Co—Ni—Si alloy for an electronic component comprising 0.5 to 3.0% by mass of Co and 0.1 to 1.0% by mass of Ni, a concentration (% by mass) ratio of Ni to Co (Ni/Co) being adjusted in the range of 0.1 to 1.0, the alloy comprising Si so that a (Co+Ni)/Si mass ratio is in the range of 3 to 5, and comprising a balance comprising Cu and unavoidable impurities, wherein a coefficient of variation of concentration ratios of Co to Ni (Co/Ni) measured for at least 100 second-phase particles is 20% or less.

(2) The alloy according to (1), further comprising up to 1.0% by mass, in total, of at least one selected from the group consisting of Fe, Mg, Sn, Zn, B, P, Cr, Zr, Ti, Al, and Mn.

(3) The alloy according to (1) or (2), wherein an average of numbers of second-phase particles having a particle size of 5 to 30 nm is $3.0\times10^8/mm^2$ or more.

(4) The alloy according to any of (1) to (3), having a 0.2% proof stress of 650 MPa or more in a direction parallel to a rolling direction and having an electrical conductivity of 50% IACS or more.

(5) The alloy according to any of (1) to (4), wherein an average roughness Ra of a surface of a bent portion when a W bending test is performed with Badway (a bending axis is in the same direction as the rolling direction) with bending radius (R)/sheet thickness (t)=1.0 is 1.0 μm or less.

(6) An electronic component comprising the alloy according to any of (1) to (5).

Effect of Invention

The present invention provides a Cu—Co—Ni—Si alloy for an electronic component having improved reliability in which in addition to high strength and high electrical conduction, bendability generally difficult to achieve with strength is also provided to a Corson copper alloy.

DESCRIPTION OF THE EMBODIMENTS

One embodiment of a Cu—Co—Ni—Si alloy for an electronic component according to the present invention will be described below. In the present invention, % indicates % by mass unless otherwise noted.

(1) Composition of Base Material

First, the alloy composition will be described. The copper alloy of the present invention is a Cu—Co—Ni—Si-based alloy. As used herein, a copper alloy obtained by adding other alloy elements such as Fe, Mg, Sn, Zn, B, P, Cr, Zr, Ti, Al, and Mn to the basic components of Cu—Co—Ni—Si is also inclusively referred to as a Cu—Co—Ni—Si-based alloy.

Co has the effect of forming Co—Ni—Si-based precipitates together with Ni and Si described later to improve the strength and electrical conductivity of the copper alloy sheet material. When the Co content is too small, it is difficult to sufficiently exhibit this effect. Therefore, the Co content is preferably 0.5% by mass or more, further preferably 0.8% by mass or more, and still more preferably 1.1% by mass or more. On the other hand, the melting point of Co is higher than that of Ni, and therefore when the Co content is too large, complete dissolution is difficult, and undissolved portions do not contribute to strength. Therefore, the Co content is preferably 3.0% by mass or less, further preferably 2.0% by mass or less.

Ni has the effect of forming Co—Ni—Si-based precipitates together with Co and Si to improve the strength and electrical conductivity of the copper alloy sheet material. When the Ni content is too small, it is difficult to sufficiently exhibit this effect. Therefore, the Ni content is preferably 0.1% by mass or more, further preferably 0.2% by mass or more, and still more preferably 0.3% by mass or more. On the other hand, when the Ni content is too large, the strength improvement effect is saturated, and moreover the electrical conductivity decreases. In addition, coarse precipitates are likely to be produced, causing cracks during bending work. Therefore, the Ni content is preferably 1.0% by mass or less, further preferably 0.8% by mass or less.

In addition, the present invention is characterized by exhibiting the effect of producing Co—Ni—Si-based precipitates to improve the strength and electrical conductivity of the copper alloy sheet material at higher levels and improve bendability. By decreasing variations in the compositions of the precipitates, strain introduced by rolling becomes uniform, leading to the improvement of a bent surface. In other words, it is required to decrease the coefficient of variation of the concentration ratios of Co to Ni (Co/Ni) to some extent in the compositions of individual precipitates. From this viewpoint, the coefficient of variation, that is, "standard deviation/average value×100," of the concentration ratios of Co to Ni (Co/Ni) in the precipitates is 20% or less, preferably 16% or less. This coefficient of variation of the concentration ratios (Co/Ni) in the precipitates is a value that can be measured and estimated for 100 or more second-phase particles that are precipitates.

In addition, in order to set such a coefficient of variation of the (Co/Ni) concentration ratios in the precipitates at a predetermined value or less, the Ni/Co concentration (% by mass) ratio in the alloy material before the precipitation of the second-phase particles should be adjusted in the range of 0.1 to 1.0, preferably 0.2 to 0.7.

Si produces Co—Ni—Si-based precipitates together with Ni and Co. However, all of Ni, Co, and Si in the alloy do not always form precipitates by aging treatment, and Ni, Co, and Si are present in a state of being dissolved in the Cu matrix, to some extent. Ni, Co, and Si in the dissolved state improve the strength of the copper alloy sheet material to some degree, but the effect is smaller than when Ni, Co, and Si are in the precipitated state, and Ni, Co, and Si in the dissolved state are factors that decrease electrical conductivity. Therefore, the Si content is generally preferably brought close to the composition ratio of a precipitate $(Ni+Co)_2Si$ as much as possible. In other words, the (Co+Ni)/Si mass ratio is generally adjusted in the range of 3 to 5 around about 4.2, and Si is added so that the (Co+Ni)/Si mass ratio is in this range.

Fe, Mg, Sn, Zn, B, P, Cr, Zr, Ti, Al, Mn, and the like may be added to the copper alloy sheet material of the present invention as needed. For example, Sn and Mg have the effect of improving stress relaxation resistance characteristics, Zn has the effect of improving the solderability and castability of the copper alloy sheet material, and Fe, Cr, Mn, Ti, Zr, Al, and the like have the action of improving strength. In addition, P has a deoxidation effect, and B has the effect of making the cast structure finer and has the effect of improving hot workability. However, when the amounts of these additive elements are too large, the manufacturability and the electrical conductivity are greatly impaired. Therefore, 0 to 1.0% by mass, in total, of these additive elements can be contained. In addition, considering the balance of strength, electrical conductivity, and bendability, 0.1 to 0.7% by mass of one or more of the above elements are preferably contained in the total amount. For each additive element, considering the balance of the improvement of stress relaxation resistance characteristics, strength, solderability, castability, and hot workability, and the like, in a range not exceeding the total amount, 0.1% by mass or more and 1.0% by mass or less of Zn can be contained, 0.1% by mass or more and 0.8% by mass or less of each of Sn and Cr can be contained, 0.1% by mass or more and 0.5% by mass or less of each of Fe, Mg, and Mn can be contained, and 0.01% by mass or more and 0.2% by mass or less of each of B, P, Zr, Ti, and Al can be contained.

(2) Strength and Electrical Conductivity

The alloy of the present invention has high strength and high electrical conductivity and is preferred for electronic components, particularly, connectors, battery terminals, jacks, relays, switches, lead frames, and the like.

Here, the strength is evaluated as 0.2% proof stress (YS) in the direction parallel to rolling measured by fabricating a JIS No. 13B test piece using a press so that the tensile direction is parallel to the rolling direction, and performing the tensile test of this test piece according to JIS-Z22241. From the viewpoint of the above-described applications, the 0.2% proof stress is preferably 650 MPa or more, particularly 700 MPa or more.

In addition, the electrical conductivity is evaluated as electrical conductivity (EC: % IACS) measured by a four-terminal method in according with JIS H0505. From the viewpoint of the above-described applications, this electrical conductivity is preferably 50% IACS or more, particularly 60% IACS or more.

(3) Bendability Surface Roughness

In the present invention, the bendability is evaluated as the average roughness Ra of the surface of a bent portion when a W bending test is performed.

In other words, as the average roughness Ra of the surface of a bent portion when a W bending test is performed with Badway (the bending axis is in the same direction as the rolling direction) with bending radius (R)/sheet thickness (t)=1.0 becomes smaller, the stress during bending work is dispersed, and the improvement of bending workability is expected. From this viewpoint, this average roughness Ra of the surface of the bent portion is preferably 1.0 μm or less.

(4) Number Concentration of Precipitates

An object of the present invention is the improvement of strength, electrical conductivity, and bendability by the control of precipitates. Therefore, the number of the precipitates is preferably evaluated. In other words, the number concentration of precipitates is evaluated as the average value of number concentration obtained by counting the number of second-phase particles having a particle size of 5 to 30 nm, dividing the number by the observation area to calculate number concentration ($\times 10^8/mm^2$), and calculating in the same manner for 20 fields of view (each field of view: 1 μm×1 μm).

Specifically, a cross section parallel to the rolling direction is cut with a focused ion beam (FIB) to expose the cross section, and then the number concentration of precipitates measured using a scanning transmission electron microscope (JEOL Ltd., model: JEM-2100F) is obtained. This number concentration of precipitates is preferably $3.0\times 10^8/mm^2$ or more, further preferably $5.0\times 10^8/mm^2$ or more, from the viewpoint of ensuring sufficient strength (0.2% proof stress).

Here, the second-phase particles refer to crystallized products formed in the solidification process of melting and casting and precipitates formed in the subsequent cooling process, precipitates formed in a cooling process after hot rolling, precipitates formed in a cooling process after solution treatment, and precipitation formed in an aging treatment process and usually have a Co—Si-based or Ni—Si-based composition, but typically have a Co—Ni—Si-based composition in the case of the present invention. The size of the second-phase particles is defined as the diameter of the largest circle that can be surrounded by precipitates when a cross section parallel to the rolling direction is subjected to structure observation in observation by an electron microscope.

(5) Applications

The Cu—Co—Ni—Si alloy according to the present invention can be worked into various elongated copper articles, for example, sheets, strips, tubes, rods, and lines. The copper alloy of the present invention is preferred as materials of electronic components such as connectors, battery terminals, jacks, relays, switches, and lead frames though these are not limiting.

(6) Manufacturing Method

The Cu—Co—Ni—Si alloy for an electronic component according to the embodiment of the present invention is manufactured through the melting and casting of an ingot-homogeneous annealing, hot rolling, quenching-cold rolling, and solution treatment-aging treatment-final cold rolling-straightening annealing.

<Ingot Manufacturing>

Raw materials such as electrolytic copper, Ni, Co, and Si are melted using an atmospheric melting furnace to obtain a molten material having the desired composition. Then, this molten material is cast into an ingot. Additive elements other than Ni, Co, and Si are added to that 0 to 1.0% by mass, in total, of one or two or more from the group consisting of Fe, Mg, Sn, Zn, B, P, Cr, Zr, Ti, Al, and Mn are contained.

<Homogenization Annealing and Hot Rolling>

The solidification segregation and crystallized products produced during the ingot manufacturing are coarse and therefore are desirably dissolved in the matrix phase and made small as much as possible and eliminated as much as possible in homogenization annealing because these adversely affect bending workability, and dissolving these in the matrix phase is effective in the prevention of bending cracks.

Specifically, after the ingot manufacturing step, the ingot is heated to 900 to 1050° C., and homogenization annealing is performed for 3 to 24 hours, and then hot rolling is carried out. The temperature is preferably 700° C. or more in a pass from the original thickness to a total draft of 90%. Then, the material is rapidly cooled to room temperature by water cooling.

<Cold Rolling and Solution Treatment>

Then, cold rolling is performed under the condition of a reduction ratio (draft) of 50% or more, preferably 70% or more, and then solution treatment is performed. Specifically, the material is heated to 900 to 1050° C. and heated for 30 seconds to 10 minutes. The solution treatment is intended to dissolve the additive elements including Ni, Co, and Si. Therefore, it is important to also control the temperature increase rate and the cooling rate in addition to the heating temperature and the heating time. During temperature increase before the solution treatment, the temperature increase rate at 600 to 700° C. that influences the precipitation of second-phase particles containing Co is controlled at 50° C./s or more. On the other hand, the cooling rate in the same temperature range after the solution treatment is also controlled at 50° C./s or more. The temperature increase rate and the cooling rate are preferably increased as much as possible also for other temperature regions. In addition, by adjusting tension applied to the material at 1 MPa or more and 10 MPa or less at this time, the precipitation of the second-phase particles can be more conveniently controlled, the coefficient of variation of the Ni/Co concentration ratios in the precipitates is set at 20% or less, the number concentration of precipitates having a particle size of 5 to 30 nm can be sufficiently ensured, and sufficient strength can be provided.

It is considered that by increasing the temperature increase and cooling rates at 600 to 700° C. during the solution treatment in this manner, the precipitation of Co—Si-based compounds is suppressed, and as a result precipitates of Co—Ni—Si-based compounds are produced. In addition, by setting the tension of the material during the solution treatment lower than conventional tension, about 20 MPa, higher strength is obtained. This mechanism is unclear, but it is considered that strain introduced when the cold rolling is performed in the previous step is uniformly released by this control of the temperature increase rate, and thus higher strength is obtained by subsequent aging treatment.

<Aging Treatment>

Following the solution treatment, aging treatment is performed. The material is preferably heated at a material temperature of 450 to 600° C. for 5 to 25 hours and more preferably heated at a material temperature of 480 to 570° C. for 10 to 20 hours. The aging treatment is preferably performed in an inert atmosphere such as Ar, $N_2$, or $H_2$ in order to suppress the generation of an oxide film.

<Final Cold Rolling>

Following the aging treatment, final cold rolling is performed. The strength can be increased by the final cold working, but in order to obtain a good balance between high strength and bending workability as intended in the present invention, it is desirable that the draft is 5 to 40%, preferably 10 to 35%.

<Straightening Annealing>

Following the final cold rolling, straightening annealing is performed. The material is preferably heated at a material temperature of 350 to 650° C. for 1 to 3600 seconds and more preferably heated at a material temperature of 350 to 450° C. for 1500 to 3600 seconds, at a material temperature of 450 to 550° C. for 500 to 1500 seconds, and at a material temperature of 550 to 650° C. for 1 to 500 seconds.

Those skilled in the art could understand that a step such as grinding, polishing, shot blasting, or pickling for the removal of the oxide scale on the surface can be appropriately performed between the above steps.

EXAMPLES

Examples (Inventive Examples) of the present invention will be shown below together with Comparative Examples. These are provided for better understanding of the present invention and advantages thereof and are not intended to limit the invention.

A copper alloy containing additive elements described in Table 1 with the balance comprising copper and impurities was melted in a high frequency melting furnace at 1300° C. and cast into an ingot having a thickness of 30 mm. Then, this ingot was heated at 1000° C. for 3 hours, then hot-rolled to a sheet thickness of 10 mm, and quickly cooled after completion of the hot rolling. Then, the material was subjected to facing to a thickness of 9 mm for the removal of the scale on the surface and then formed into a sheet having a thickness of 0.111 to 0.167 mm by cold rolling. Next, the sheet was subjected to solution treatment at 950° C. for 120 seconds. The temperature increase rate and the cooling rate and the tension in the temperature range of 600 to 700° C. at this time are as described in Table 1. Then, the sheet was subjected to aging treatment and cold rolling under conditions in Table 1 to a sheet thickness of 0.1 mm. Finally, the sheet was subjected to straightening annealing at a material temperature of 400° C. for 2000 seconds.

TABLE 1

| | Components (% by mass) | | | | | | Solution treatment | | | | |
|---|---|---|---|---|---|---|---|---|---|---|---|
| Example | Co | Ni | Ni/Co | Si | (Co + Ni)/Si | Additive elements | Temperature increase rate (° C./s) at 600 to 700° C. | Cooling rate (° C./s) at 600 to 700° C. | Tension (Mpa) | Aging treatment Conditions | Final cold rolling Reduction ratio (%) |
| Inventive Example 1 | 1.5 | 0.5 | 0.33 | 0.48 | 4.2 | — | 65 | 65 | 4 | 525° C. × 20 h | 25 |
| Inventive Example 2 | 1.5 | 0.5 | 0.33 | 0.48 | 4.2 | — | 55 | 65 | 4 | 525° C. × 20 h | 25 |
| Inventive Example 3 | 1.5 | 0.6 | 0.33 | 0.48 | 4.2 | — | >100 | 65 | 4 | 525° C. × 20 h | 25 |
| Inventive Example 4 | 1.5 | 0.6 | 0.33 | 0.48 | 4.2 | — | 65 | 55 | 4 | 525° C. × 20 h | 25 |
| Inventive Example 5 | 1.5 | 0.6 | 0.33 | 0.48 | 4.2 | — | 65 | >100 | 4 | 525° C. × 20 h | 25 |
| Inventive Example 6 | 1.5 | 0.6 | 0.33 | 0.48 | 4.2 | — | 65 | 65 | 2 | 525° C. × 20 h | 25 |
| Inventive Example 7 | 1.5 | 0.6 | 0.33 | 0.48 | 4.2 | — | 65 | 65 | 9 | 525° C. × 20 h | 25 |
| Inventive Example 8 | 1.5 | 0.6 | 0.33 | 0.48 | 4.2 | — | 65 | 65 | 4 | 450° C. × 25 h | 25 |
| Inventive Example 9 | 1.5 | 0.6 | 0.33 | 0.48 | 4.2 | — | 65 | 65 | 4 | 600° C. × 5 h | 25 |
| Inventive Example 10 | 1.5 | 0.6 | 0.33 | 0.48 | 4.2 | — | 65 | 65 | 4 | 525° C. × 20 h | 10 |
| Inventive Example 11 | 1.5 | 0.6 | 0.33 | 0.48 | 4.2 | — | 65 | 65 | 4 | 525° C. × 20 h | 40 |
| Inventive Example 12 | 0.8 | 0.5 | 0.63 | 0.31 | 4.2 | — | 65 | 65 | 8 | 525° C. × 20 h | 25 |
| Inventive Example 13 | 2.7 | 0.5 | 0.19 | 0.77 | 4.2 | — | 65 | 65 | 5 | 450° C. × 20 h | 25 |
| Inventive Example 14 | 1.4 | 0.2 | 0.14 | 0.38 | 4.2 | — | 65 | 65 | 5 | 550° C. × 10 h | 25 |
| Inventive Example 15 | 1.0 | 0.5 | 0.90 | 0.45 | 4.2 | — | 65 | 65 | 5 | 500° C. × 20 h | 25 |
| Inventive Example 16 | 1.5 | 0.5 | 0.33 | 0.62 | 3.2 | — | 65 | 65 | 4 | 600° C. × 5 h | 25 |
| Inventive Example 17 | 1.5 | 0.5 | 0.33 | 0.42 | 4.8 | — | 65 | 65 | 4 | 525° C. × 20 h | 25 |
| Inventive Example 18 | 1.5 | 0.5 | 0.33 | 0.48 | 4.2 | 0.5Zn—0.3Sn | 80 | 65 | 5 | 450° C. × 20 h | 25 |
| Inventive Example 19 | 1.5 | 0.5 | 0.33 | 0.48 | 4.2 | 0.2Fe—0.1Mg | 65 | 60 | 4 | 550° C. × 20 h | 20 |
| Inventive Example 20 | 1.5 | 0.5 | 0.33 | 0.48 | 4.2 | 0.05B—0.05P | 70 | 80 | 5 | 500° C. × 20 h | 30 |
| Inventive Example 21 | 1.5 | 0.5 | 0.33 | 0.48 | 4.2 | 0.5Cr—0.05Ti | 65 | 65 | 7 | 525° C. × 20 h | 30 |
| Inventive Example 22 | 1.5 | 0.5 | 0.33 | 0.48 | 4.2 | 0.1Zr | 85 | 60 | 4 | 525° C. × 20 h | 20 |
| Inventive Example 23 | 1.5 | 0.5 | 0.33 | 0.48 | 4.2 | 0.2Mn—0.1Al | 65 | 85 | 7 | 525° C. × 20 h | 25 |
| Comparative Example 1 | 1.5 | 0.5 | 0.33 | 0.48 | 4.2 | — | 40 | 70 | 4 | 525° C. × 20 h | 25 |
| Comparative Example 2 | 1.5 | 0.5 | 0.33 | 0.48 | 4.2 | — | 70 | 40 | 4 | 525° C. × 20 h | 25 |
| Comparative Example 3 | 1.5 | 0.5 | 0.33 | 0.48 | 4.2 | — | 65 | 65 | 0 | 525° C. × 20 h | 25 |
| Comparative Example 4 | 1.5 | 0.5 | 0.33 | 0.48 | 4.2 | — | 65 | 65 | 15 | 525° C. × 20 h | 25 |
| Comparative Example 5 | 0.3 | 0.2 | 0.67 | 0.12 | 4.2 | — | 65 | 65 | 4 | 525° C. × 20 h | 25 |
| Comparative Example 6 | 3.5 | 0.5 | 0.14 | 0.95 | 4.2 | — | 65 | 65 | 4 | 525° C. × 20 h | 25 |
| Comparative Example 7 | 1.5 | 0 | 0 | 0.36 | 4.2 | — | 65 | 65 | 4 | 525° C. × 20 h | 25 |
| Comparative Example 8 | 1.5 | 1.2 | 0.80 | 0.64 | 4.2 | — | 65 | 65 | 4 | 525° C. × 20 h | 25 |
| Comparative Example 9 | 2.0 | 0.1 | 0.05 | 0.50 | 4.2 | — | 65 | 65 | 4 | 525° C. × 20 h | 25 |
| Comparative Example 10 | 0.7 | 0.9 | 1.29 | 0.38 | 4.2 | — | 65 | 65 | 4 | 525° C. × 20 h | 25 |
| Comparative Example 11 | 1.5 | 0.5 | 0.33 | 0.75 | 2.7 | — | 65 | 65 | 4 | 525° C. × 20 h | 25 |
| Comparative Example 12 | 1.5 | 0.5 | 0.33 | 0.38 | 5.3 | — | 65 | 65 | 4 | 525° C. × 20 h | 25 |

TABLE 1-continued

| Example | Components (% by mass) Co | Ni | Ni/Co | Si | (Co + Ni)/Si | Additive elements | Solution treatment: Temperature increase rate (° C./s) at 600 to 700° C. | Cooling rate (° C./s) at 600 to 700° C. | Tension (Mpa) | Aging treatment Conditions | Final cold rolling Reduction ratio (%) |
|---|---|---|---|---|---|---|---|---|---|---|---|
| Comparative Example 13 | 1.5 | 0.5 | 0.33 | 0.48 | 4.2 | 1.0Sn—0.3Fe | 65 | 65 | 4 | 525° C. × 20 h | 25 |
| Comparative Example 14 | 1.5 | 0.5 | 0.33 | 0.48 | 4.2 | — | 100 | 100 | 20 | 500° C. × 5 h | 30 |
| Comparative Example 15 | 1.5 | 0.5 | 0.33 | 0.48 | 4.2 | — | 40 | 30 | 20 | 500° C. × 5 h | 30 |

For the fabricated product samples, the following evaluations were performed. The results of the evaluations are shown in Table 2.

(1) 0.2% Proof Stress

A JIS No. 13B test piece was fabricated using a press so that the tensile direction was parallel to the rolling direction. The tensile test of this test piece was performed according to JIS-Z2241 to measure 0.2% proof stress (YS) in the direction parallel to rolling.

(2) Electrical Conductivity

The electrical conductivity (EC: % IACS) was measured by a four-terminal method in accordance with JIS H0505.

(3) Surface Roughness of Bent Portion

A W bending test was carried out with Badway (the bending axis was in the same direction as the rolling direction) and R/t=1.0 (t=0.1 mm) according to JIS-H3130 (2012), and the outer peripheral surface of the bent portion of this test piece was observed. For the observation method, the outer peripheral surface of the bent portion was photographed using a confocal microscope HD100 manufactured by Lasertec Corporation, and the average roughness Ra (in accordance with JIS-B0601: 2013) was measured using the attached software and compared. When the sample surface before the bending work was observed using the confocal microscope, unevenness could not be confirmed, and each average roughness Ra was 0.2 μm or less.

A case where the surface average roughness Ra after the bending work was 1.0 μm or less was evaluated as circle, and a case where Ra exceeded 1.0 μm was evaluated as X-mark.

(4) Number Concentration of Precipitates Having Particle Size of 5 to 30 nm

A cross section parallel to the rolling direction was cut with a focused ion beam (FIB) to expose the cross section, and then the number concentration of precipitates was measured using a scanning transmission electron microscope (JEOL Ltd., model: JEM-2100F).

Specifically, the acceleration voltage was set at 200 kV, the observation magnification was set at 1000000×, and the number of second-phase particles having a particle size of 5 to 30 nm was counted and divided by the observation area to calculate number concentration ($\times 10^8/mm^2$). Measurement was performed in the same manner for 20 fields of view, and the average value was taken as the number concentration.

(5) Coefficient of Variation of Concentration Ratios (Co/Ni) in Precipitates

The Co/Ni concentration ratios of the precipitates were measured using an energy-dispersive X-ray analyzer (EDX, JEOL Ltd., model: JED-2300) as the detector of a STEM. Specifically, the acceleration voltage and the observation magnification were the same as the above conditions, and the spot diameter of the electron beam was 0.2 nm. The Co/Ni concentration ratios were measured for 100 or more second-phase particles (that is, precipitates) respectively. Then, the average value and the standard deviation were calculated, and the coefficient of variation (standard deviation/average value×100) was obtained.

TABLE 2

| Example | Final characteristics: 0.2% Proof stress (MPa) | Electrical conductivity (% IACS) | Surface roughness of bent portion | Number concentration of precipitates having particle size of 5 to 30 nm ($\times 10^8/mm^2$) | Coefficient of varation of Co/Ni concentration ratios in precipitates (%) |
|---|---|---|---|---|---|
| Inventive Example 1 | 760 | 61 | ○ | 8.1 | 12 |
| Inventive Example 2 | 742 | 60 | ○ | 8.8 | 17 |
| Inventive Example 3 | 765 | 59 | ○ | 7.4 | 16 |
| Inventive Example 4 | 745 | 62 | ○ | 9.1 | 16 |
| Inventive Example 5 | 761 | 59 | ○ | 7.3 | 18 |
| Inventive Example 6 | 740 | 58 | ○ | 8.2 | 16 |
| Inventive Example 7 | 744 | 60 | ○ | 8.3 | 17 |
| Inventive Example 8 | 721 | 55 | ○ | 6.5 | 17 |
| Inventive Example 9 | 715 | 65 | ○ | 10.6 | 18 |
| Inventive Example 10 | 685 | 61 | ○ | 7.7 | 10 |
| Inventive Example 11 | 781 | 57 | ○ | 8.6 | 13 |
| Inventive Example 12 | 658 | 72 | ○ | 3.5 | 8 |
| Inventive Example 13 | 822 | 51 | ○ | 12.4 | 13 |
| Inventive Example 14 | 688 | 67 | ○ | 5.1 | 15 |
| Inventive Example 15 | 677 | 51 | ○ | 7.2 | 12 |
| Inventive Example 16 | 674 | 55 | ○ | 8.0 | 13 |
| Inventive Example 17 | 559 | 60 | ○ | 6.6 | 10 |
| Inventive Example 18 | 681 | 54 | ○ | 7.2 | 12 |
| Inventive Example 19 | 671 | 56 | ○ | 8.2 | 14 |

TABLE 2-continued

| Example | Final characteristics | | | | |
|---|---|---|---|---|---|
| | 0.2% Proof stress (MPa) | Electrical conductivity (% IACS) | Surface roughness of bent portion | Number concentration of precipitates having particle size of 5 to 30 nm ($\times 10^8/mm^2$) | Coefficient of varation of Co/Ni concentration ratios in precipitates (%) |
| Inventive Example 20 | 661 | 61 | ○ | 8.1 | 10 |
| Inventive Example 21 | 682 | 56 | ○ | 7.4 | 12 |
| Inventive Example 22 | 673 | 58 | ○ | 7.3 | 8 |
| Inventive Example 23 | 685 | 61 | ○ | 7.5 | 13 |
| Comparative Example 1 | 742 | 61 | x | 7.5 | 27 |
| Comparative Example 2 | 756 | 62 | x | 8.2 | 26 |
| Comparative Example 3 | 761 | 58 | x | 8.1 | 23 |
| Comparative Example 4 | 738 | 58 | x | 7.7 | 25 |
| Comparative Example 5 | 580 | 72 | ○ | 0.2 | 13 |
| Comparative Example 6 | 872 | 46 | x | 12.5 | 12 |
| Comparative Example 7 | 641 | 65 | x | 5.5 | 12 |
| Comparative Example 8 | 805 | 47 | x | 10.6 | 15 |
| Comparative Example 9 | 674 | 64 | x | 6.5 | 13 |
| Comparative Example 10 | 681 | 48 | x | 5.2 | 14 |
| Comparative Example 11 | 631 | 55 | x | 2.8 | 16 |
| Comparative Example 12 | 638 | 62 | x | 1.5 | 18 |
| Comparative Example 13 | 732 | 53 | x | 6.5 | 28 |
| Comparative Example 14 | 730 | 55 | x | 5.7 | 29 |
| Comparative Example 15 | 744 | 57 | x | 5.9 | 34 |

Each of Inventive Examples 1 to 23 had a good balance: the 0.2% proof stress was 650 MPa or more, the electrical conductivity was 50% IACS or more, the surface roughness of the bent portion was good, 1.0 μm or less, and the coefficient of variation of the Co/Ni concentration ratios in the precipitates was also 20% or less. It can be said that these copper alloy materials have an excellent balance of high strength, high electrical conductivity, and high bending workability.

Comparative Examples 1 to 15 are each a specific example in which it is considered that the precipitation of the second-phase particles cannot be sufficiently controlled.

Comparative Example 1 is a specific example in which the temperature increase rate during the solution treatment is smaller than 50° C./s, and Comparative Example 2 is a specific example in which the cooling rate during the solution treatment is smaller than 50° C./s. It was found that in each of Comparative Examples 1 and 2, the coefficient of variation of the Co/Ni concentration ratios in the precipitates was 20% or more, and it was difficult to exhibit sufficient bending workability.

Comparative Examples 3 and 4 are a specific example in which the tension applied to the alloy material during the solution treatment is too small (Comparative Example 3) and a specific example in which the tension applied to the alloy material during the solution treatment is too large (Comparative Example 4). As a result, it was found that the coefficient of variation of the Co/Ni concentration ratios in the precipitates was 20% or more, and it was difficult to exhibit sufficient bending workability.

Comparative Example 5 is a specific example in which the Co content in the components of the copper alloy is smaller than 0.5% by mass. It was found that when the Co content was small, a sufficient amount could not be ensured in the number concentration of precipitates having a particle size of 5 to 30 nm considered to contribute to strength, and as a result it was difficult to exhibit sufficient strength.

Comparative Example 6 in a specific example in which the Co content in the components of the copper alloy is larger than 3.0% by mass. It was found that when the Co content was large, it was difficult to exhibit sufficient electrical conductivity and bending workability.

Comparative Example 7 is a specific example in which Ni is not contained in the copper alloy, that is, the Ni content is smaller than 0.1% by mass. It was found that when the Ni content was small, it was difficult to exhibit sufficient bending workability.

Comparative Example 8 is a specific example in which the Ni content in the components of the copper alloy exceeds 1.0% by mass. It was found that when the Ni content was large, it was difficult to exhibit sufficient electrical conductivity and bending workability.

Comparative Example 9 is a specific example in which the Ni/Co mass ratio in the components of the copper alloy is smaller than 0.1. It was found that when this mass ratio was small, it was difficult to exhibit sufficient bending workability.

Comparative Example 10 is a specific example in which the Ni/Co mass ratio in the components of the copper alloy is larger than 1.0. It was found that when this mass ratio was large, it was difficult to exhibit sufficient electrical conductivity and bending workability.

Comparative Examples 11 and 12 are a specific example in which the (Co+Ni)/Si mass ratio in the copper alloy is too small (Comparative Example 11) and a specific example in which the (Co+Ni)/Si mass ratio in the copper alloy is too large (Comparative Example 12). When the (Co+Ni)/Si mass ratio was not in a proper range, the result was that the number concentration of precipitates having a particle size of 5 to 30 nm was not sufficient, and the copper alloy material was poor in terms of both strength and bending workability.

Comparative Example 13 is a specific example in which the total amount of third additive elements other than Ni, Co, and Si exceeds 1.0. When the amounts of the third additive elements were too large, the result was that the coefficient of variation of the Co/Ni concentration ratios in the precipitates was 20% or more, and the copper alloy material was poor in bending workability.

Comparative Examples 14 and 15 are specific examples in which the tension applied to the alloy material during the solution treatment is large.

Comparative Example 14 is a specific example representing the mode in Japanese Patent Laid-Open No. 2009-

007666. It was found that the coefficient of variation of the Co/Ni concentration ratios in the precipitates was 20% or more, and it was difficult to exhibit sufficient bending workability.

Comparative Example 15 is a specific example representing the mode in International Publication No. WO 2011/068124, in which further each of the temperature increase rate and the cooling rate at 600 to 700° C. during the solution treatment is smaller than 50° C./s. It was found that the coefficient of variation of the Co/Ni concentration ratios in the precipitates was 20% or more, and it was difficult to exhibit sufficient bending workability.

The invention claimed is:

1. A Cu—Co—Ni—Si alloy for an electronic component comprising:

0.5 to 3.0% by mass of Co and 0.1 to 1.0% by mass of Ni, wherein the ratio of the concentration (% by mass) of Ni to Co (Ni/Co) is in the range of 0.1 to 1.0, Si so that the (Co+Ni)/Si mass ratio of the alloy is in the range of 3 to 5, the balance of the alloy comprising Cu and unavoidable impurities, and optionally up to 1.0% by mass, in total, of at least one selected from the group consisting of Fe, Mg, Sn, Zn, B, P, Cr, Zr, Ti, Al, and Mn, wherein a coefficient of variation of concentration ratios of Co to Ni (Co/Ni) measured for at least 100 second-phase particles is 20% or less.

2. The alloy according to claim 1, comprising up to 1.0% by mass, in total, of at least one selected from the group consisting of Fe, Mg, Sn, Zn, B, P, Cr, Zr, Ti, Al, and Mn.

3. The alloy according to claim 1, wherein an average of number of second-phase particles having a particle size of 5 to 30 nm is $3.0\times10^8/mm^2$ or more.

4. The alloy according to claim 1, comprising a 0.2% proof stress of 650 MPa or more in a direction parallel to a rolling direction and comprising an electrical conductivity of 50% IACS or more.

5. The alloy according to claim 1, wherein an average roughness Ra of a surface of a bent portion of the alloy is 1.0 μm or less as determined by a W bending test performed with a bending axis in the same direction as the rolling direction and a bending radius (R)/sheet thickness (t) of 1.0.

6. An electronic component comprising the alloy according to claim 1.

* * * * *